United States Patent [19]

Scott et al.

[11] 3,965,951

[45] June 29, 1976

[54] SINGLE CHEMICAL ELECTRIC DETONATOR

[75] Inventors: Calvin L. Scott, Washington, D.C.; Howard S. Leopold, Silver Spring, Md.

[73] Assignee: The United States of America as represented by the Secretary of the Navy, Washington, D.C.

[22] Filed: Nov. 8, 1974

[21] Appl. No.: 522,077

[52] U.S. Cl. ..... 149/23; 149/88; 102/28 R

[51] Int. Cl.[2] ..... C06B 41/00

[58] Field of Search ..... 149/23, 88; 102/28

[56] References Cited

UNITED STATES PATENTS 3,173,921 3/1965 Einberg ..... 149/23 X

*Primary Examiner*—Stephen J. Lechert, Jr.

[57] ABSTRACT

Mercuric-5-nitrotetrazole in an electrical explosive detonator serves as the sole explosive charge for detonating a secondary explosive.

2 Claims, No Drawings

SINGLE CHEMICAL ELECTRIC DETONATOR

BACKGROUND OF THE INVENTION

This invention relates to ammunition and explosive devices and more particularly to an electric explosive detonator having mercuric-5-nitrotetrazole as the sole explosive charge and to a method of detonating a secondary explosive.

In the field of explosives, problems exist with detonators. There are four separate and distinct subdivisions in the explosive field — (1) primary explosives, (2) secondary explosives, (3) propellants and (4) pyrotechnics. This invention concerns a primary explosive and its use in an electrical detonator to detonate a secondary explosive.

A secondary explosive provides the blasting and shattering power normally associated with the generic term explosive. A secondary explosive, while usually powerful, is not usually sensitive or easily detonated. It, thus, becomes necessary to provide a primary explosive, which is more sensitive and can initiate the secondary explosive detonation. Customarily, the primary explosive is housed in a detonator; which, in turn, is connected in an explosive and detonable relationship with secondary explosive.

The use of electrical detonators is common in the explosive arts. The problems of a primary explosive incorporated in an electrical detonator are thoroughly discussed in U.S. Pat. No. 3,340,808 to Leopold incorporated herein by reference. Briefly summarized, these problems include maintaining the sensitivity and output of the detonator while providing safety. Prior art detonators typically contain two or three separate explosive charges of differing sensitivities. With each of the charges, however, loading complications are multiplied. To avoid the loading problems of two or three separate explosive charges, a mixture of charges is a possibile solution. While this procedure simplifies loading, it does not completely solve the safety and sensitivity problems.

It, therefore, appears that a single-component explosive charge is a suitable solution eliminating some drawbacks of the mixed explosive, and the loading problem of the two or three separate explosive charges in the detonator. However, the singlecomponent explosive charge must maintain the desired sensitivity, safety, and output with regard to electrical detonation. Thus, there are a variety of factors which must be considered in selecting an explosive charge for an electrical detonator.

SUMMARY OF THE INVENTION

Therefore, it is an object of this invention to provide an improved single component explosive charge for an electrical detonator.

Also, an object of this invention is to provide an improved, single-component explosive charge for an electrical detonator to detonate a secondary explosive.

It is a further object of this invention to provide an improved, single-component explosive charge for an electrical detonator to simplify loading of an electrical detonator.

It is a still further object of this invention to provide an improved single-component, explosive charge to avoid explosive charge mixing problems.

Another object of this invention is to provide a safe, improved, single-component explosive charge for an electrical detonator.

Yet another object of this invention is to provide a sensitive, improved, single-component, explosive charge for an electrical detonator.

These and other objects of the invention are met by providing mercuric 5-nitrotetrazole as a single component explosive charge in an electrical detonator and using that electrical detonator to detonate a secondary explosive.

DESCRIPTION OF THE PREFERRED EMBODIMENTS

Mercuric-5-nitrotetrazole has the sensitivity and stability to be a single component explosive charge in an electrical detonator used with a secondary explosive and has a formula of

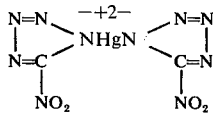

Research and experimentation illustrate that mercuric 5-nitrotetrazle is suitable for use as the explosive charge in an electrical detonator such as the detonator disclosed in U.S. Pat. No. 3,340,808 to Leopold incorporated herein by reference. Loading of the detonator is by any standard fashion such as that disclosed in the Leopold patent.

EXAMPLE I

Two electrical detonators having an explosive charge housing are loaded with mercuric-5-nitrotetrazole as described in the above referenced Leopold patent in single or multiple steps.

Mercuric-5-nitrotetrazole is test fired in a standard electric detonator in 54 milligram charges at a pressure of 10,000 psi (about 700 kilograms per square centimeter). The firing requires 55–56 volts which is comparable to the 56 volts required of the first charge in a three component system. It is also less sensitive to spark than the first charge. The first charge referred herein is normal lead styphnate.

In the standard steel dent test, a detonator loaded with mercuric-5-nitrotetrazole provides a dent of 21.8 mils (0.55mm). The standard detonator of the three component charge and of a comparable mixed charge produces a dent of 16 to 19 mils. (0.41mm to 0.48mm).

Thus, it appears that the one component detonator is comparable to the prior art detonators.

EXAMPLE II

Mercuric-5-nitrotetrazole is tested and compared to dextrinitrate lead azide as indicated in Table I. In each case, the mercuric-5-nitrotetrazole is superior to lead azide for detonator use.

TABLE I

PROPERTIES OF MERCURIC-5-NITROTETRAZOLE AND OF DEXTRINITED LEAD AZIDE

| | Mercuric 5-Nitrotetrazole | Dextrinated Lead Azide |
|---|---|---|
| Explosion Temperature °C | 232 | 340 |
| Impact Sensitivity, NOL Machine, Type 12 Tools, 50 Percent Height, CM | | |
| Sand Paper | 11.0 | 3.5–4 |
| Bare Tools | 5.5 | 3.5–4 |
| Vacuum Thermal Stability At 100°C | | |
| ml/gm/48 Hours | 0.2 | |
| ml/gm/40 Hours | | 0.23–0.41 |
| Electrostatic Sensitivity, Energy, ERGS | | |
| Max. No-Fire, 0.1 mfd | $0.50 \times 10^6$ | $0.125 \times 10^6$ |
| Hot Wire Sensitivity, Volts | | |
| 10 mg At 10K psi On A 1 mil Bridge Wire Capacitor Discharge Of 1 mfd Capacitor | 56 | 76 |

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. In an electrical explosive detonator including a container for an explosive charge, the improvement wherein the explosive charge consists solely of mercuric-5-nitrotetrazole.

2. In a method of detonating a secondary explosive with an electrical detonator wherein the electrical detonator contains an explosive charge, the improvement comprising an explosive charge consisting solely of mercuric-5-nitrotetrazole.

* * * * *